United States Patent [19]

Arnaudeau

[11] 4,371,037

[45] Feb. 1, 1983

[54] TRANSFER TERMINAL FOR OFFSHORE PRODUCTION

[75] Inventor: Marcel Arnaudeau, Paris, France

[73] Assignee: Institut Francais du Petrole, Rueil-Malmaison, France

[21] Appl. No.: 216,452

[22] Filed: Dec. 15, 1980

Related U.S. Application Data

[63] Continuation-in-part of Ser. No. 11,817, Feb. 9, 1979, Pat. No. 4,265,313.

[30] Foreign Application Priority Data

Feb. 14, 1978 [FR] France ..... 78 04330

[51] Int. Cl.[3] ..... E21B 43/017

[52] U.S. Cl. ..... 166/366; 114/230; 166/367; 285/133 A; 441/4

[58] Field of Search ..... 166/359, 367, 366, 338, 166/341, 344, 345; 441/3, 4, 5; 114/230; 285/61, 18, 133 A

[56] References Cited

U.S. PATENT DOCUMENTS

| | | | |
|---|---|---|---|
| 3,421,580 | 1/1969 | Fowler et al. | 166/359 |
| 3,503,443 | 3/1970 | Blanding et al. | 166/344 |
| 3,590,407 | 7/1971 | Bratianu | 114/230 X |
| 3,682,242 | 8/1972 | Brooks et al. | 166/366 X |
| 3,778,854 | 12/1973 | Chow | 441/4 |
| 3,827,486 | 8/1974 | Hall | 166/362 |
| 3,881,549 | 5/1975 | Thomas | 166/367 |
| 3,945,066 | 3/1976 | Davies | 441/5 |
| 4,052,090 | 10/1977 | Stafford | 285/61 |
| 4,100,752 | 7/1978 | Tucker | 441/4 X |

*Primary Examiner*—Stephen J. Novosad

*Attorney, Agent, or Firm*—Millen & White

[57] ABSTRACT

A mooring station and transfer terminal for offshore hydrocarbon production is provided, comprising a co-axial riser linking underwater production and safety manifolds to surface lines. An underwater connector and quick release means are provided to facilitate rapid connection and disconnection of the riser pipes.

12 Claims, 6 Drawing Figures

TRANSFER TERMINAL FOR OFFSHORE PRODUCTION

REFERENCE TO RELATED APPLICATION

This application is a continuation-in-part of Ser. No. 011,817, filed Feb. 9, 1979, now U.S. Pat. No. 4,265,313, of Marcel Arnaudeau for New Mooring Station and Transfer Terminal for Offshore Hydrocarbon Production.

BACKGROUND OF THE INVENTION

The present invention relates to a mooring station and transfer terminal for offshore hydrocarbon production, suitable for mooring oil processing and/or transportation ships.

At the present time offshore hydrocarbon production is developing at locations remote from conventional harbors and this, added to the continuous weight increase of oil tanders, leads to building artificial terminals for mooring oil tankers during loading thereof and/or ships for processing the oil-containing effluent from the producing wells.

Known mooring stations and transfer terminals are connected to a plurality of production underwater wellheads, these terminals comprising a caisson surmounted by at least one rotatable arm which supports at least one pipe for loading oil tankers.

In such prior arrangements the different producing wellheads are connected through pipelines to a production manifold lying on the water bottom, this manifold being connected to the caisson through a gathering line lying on the water bottom and a riser connecting this gathering line to the loading pipe supported by the caisson.

It is also known to provide circulation and safety means through which fluid may circulate during servicing operations on a wellhead, and which provide means for controlling the pressure in the annular space of the producing well.

In the prior art, the various lines and pipes leading from subsurface facilities to surface processing, loading or safety means are often contained within a common riser. For example, such an arrangement is shown in U.S. Pat. No. 3,881,549.

A coaxial safety production pipe is disclosed in U.S. Pat. No. 3,827,486, having a central production pipe and annular, coaxial hydraulic safety valve supply circuits. However, the annular hydraulic circuits do not communicate between separate manifolds and surface facilities. Rather, they serve to seal off the well in the event of damage to the casing.

OBJECTS OF THE INVENTION

One object of the present invention is to provide a mooring station and transfer terminal having a riser which can accommodate at least a production pipe and a circulation and safety pipe, and which can be quickly connected and disconnected to underwater production and safety manifolds.

Another object of the invention is to provide an offshore hydrocarbon production facility which is suitable for operation at great depths.

Upon further study of the specification and appended claims, further objects and advantages of this invention will become apparent to those skilled in the art.

SUMMARY OF THE INVENTION

Briefly, these and other objects are achieved according to this invention with a mooring station and transfer terminal for offshore hydrocarbon production from a plurality of underwater wells connected to a plurality of production lines, each line communicating with one of said wells, said mooring station and transfer terminal comprising at least one underwater production manifold communicating with said production lines; at least one underwater circulation and safety manifold communicating with said plurality of underwater wells; a riser comprising at least two coaxial pipes defining at least one annular space therebetween, said coaxial pipe including at least one production pipe communicating at its lower end with said production manifold and at least one circulation and safety pipe communicating at its lower end with said circulation and safety manifold; and a surface facility comprising means for receiving the outflow of said at least one production pipe and communicating with the upper end thereof, said surface facility further comprising a source of safety fluid communicating with the upper end of said circulation and safety pipe.

DETAILED DISCUSSION

The manifolds will advantageously be housed in a water-tight caisson which may rest on the water bottom. According to an embodiment which is more fully described hereinunder, it is advantageous to use a caisson of positive buoyancy which is held submerged at a depth sufficient to preserve it from the action of swell, the producing wells being connected through flexible pipes to the manifolds located in the caisson.

Figure 1:
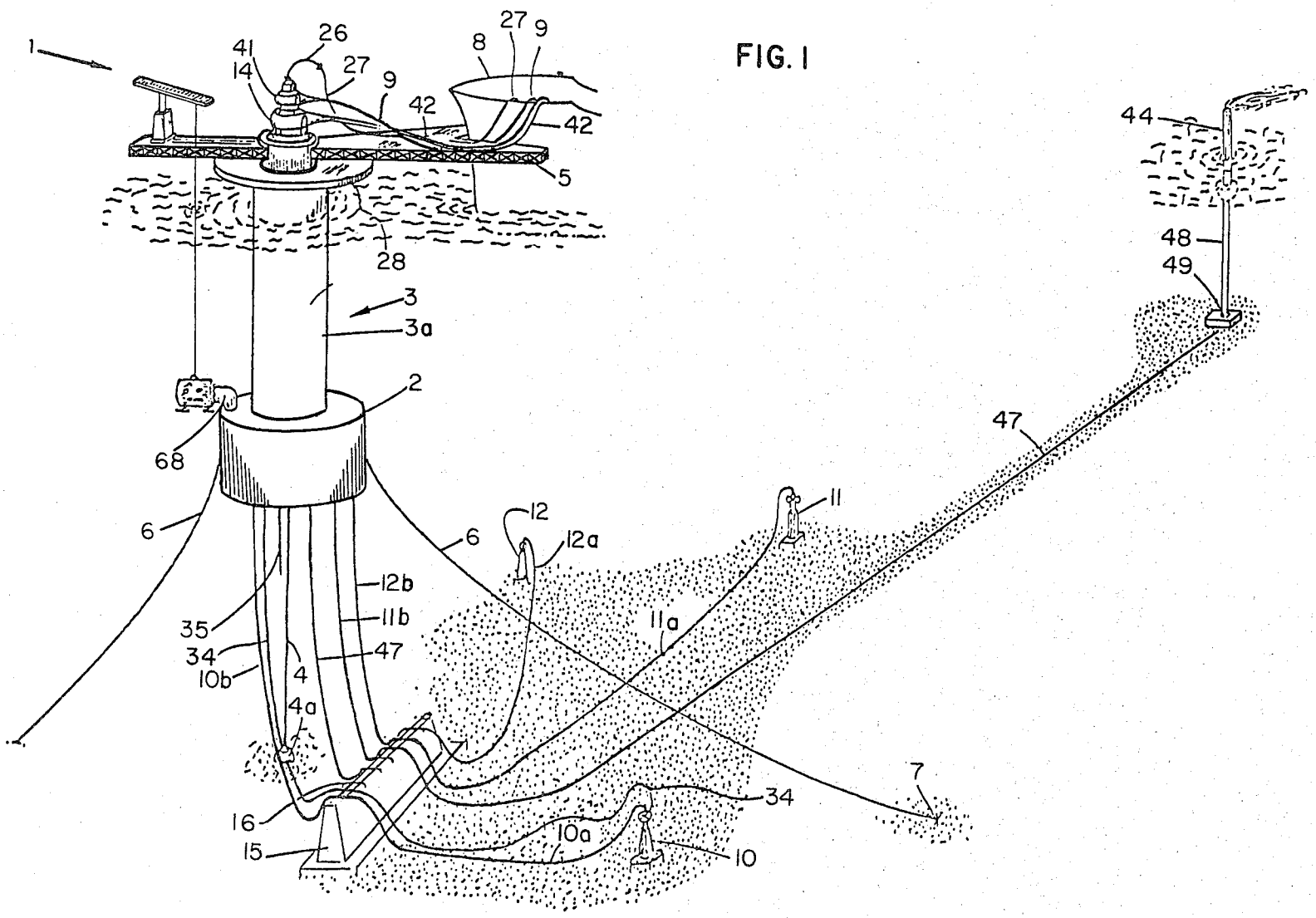
FIG. 1 is an overall view of a first embodiment of a mooring station and transfer terminal according to the invention.

FIG. 1 represents one embodiment of a mooring station and transfer terminal 1 according to the invention, comprising a watertight caisson 2 which supports a rotatable arm 5 via a riser 3 formed of a thick-walled tube 3*a*, and a telescopic assembly of two coaxial pipes. The watertight caisson 2 has a positive buoyancy and is held submerged by one or more vertical lines 4, e.g., cables or chains, secured to the water bottom by weights 4*a*. The terminal 1 is held in position by anchoring means comprising mooring lines 6 and anchors 7. Mooring lines 6 may either be secured to caisson 2, as illustrated, or to an annular element 28 located just under rotatable arm 5.

The rotatable arm 5 permits mooring of an oil tanker 8 and loading of this tanker through one or more loading pipes 9 carried by arm 5 and which are connected through any suitable means to the tanks of ship 8. Arm 5 may be U- or V- shaped, as illustrated in FIG. 1, to facilitate mooring of the prow of ship 8.

The different producing wellheads, such as 10, 11 and 12 are connected through flexible flowlines 10*a*, 11*a* and 12*a* and risers 10*b*, 11*b* and 12*b* to a production manifold 13 (FIG. 2) housed in caisson 2.

Connection of a flexible production riser such as riser 10*b* to manifold 13 is achieved through conduits or rigid tubular connectors such as 10*c* and 10*d*.

In the embodiment illustrated by FIG. 1, the flexible flowlines 10*a* and 10*b* are locally supported, in the vicinity of the water bottom, by guide means comprising, for example, a support member 15 provided with guide elements 16 having rounded rims to limit bending stresses in the supported flexible pipes at their location.

Caisson 2 also houses a second manifold 33 providing for the safety of the oil field and of the installation by permitting fluid injection into the wells from the water surface through a circulation and safety pipe 42 carried by arm 5. This manifold 33 is connected to the different wellheads through flexible pipes such as 34, 35 and conduits such as conduit 38. Flexible pipes such as 34, 35 have two main purposes which are well known in the art: first they may be used as fluid circulation pipes during servicing operations and in addition they are used as safety pipes for controlling the pressure in the annular space of the producing well. Connection of flexible pipe 34 to wellhead 10 is shown in FIG. 1.

Return circulation of a fluid flow injected into a well such as well 10 can be achieved via flowline 10*a*, riser 10*b* and tubular connector 10*c* without interrupting the production of the other wells through a third manifold 29 (return circulation manifold) equipped with manually operated or remotely controlled valves such as valve 20 connected to the tubular connector 10*c*.

Figure 2:
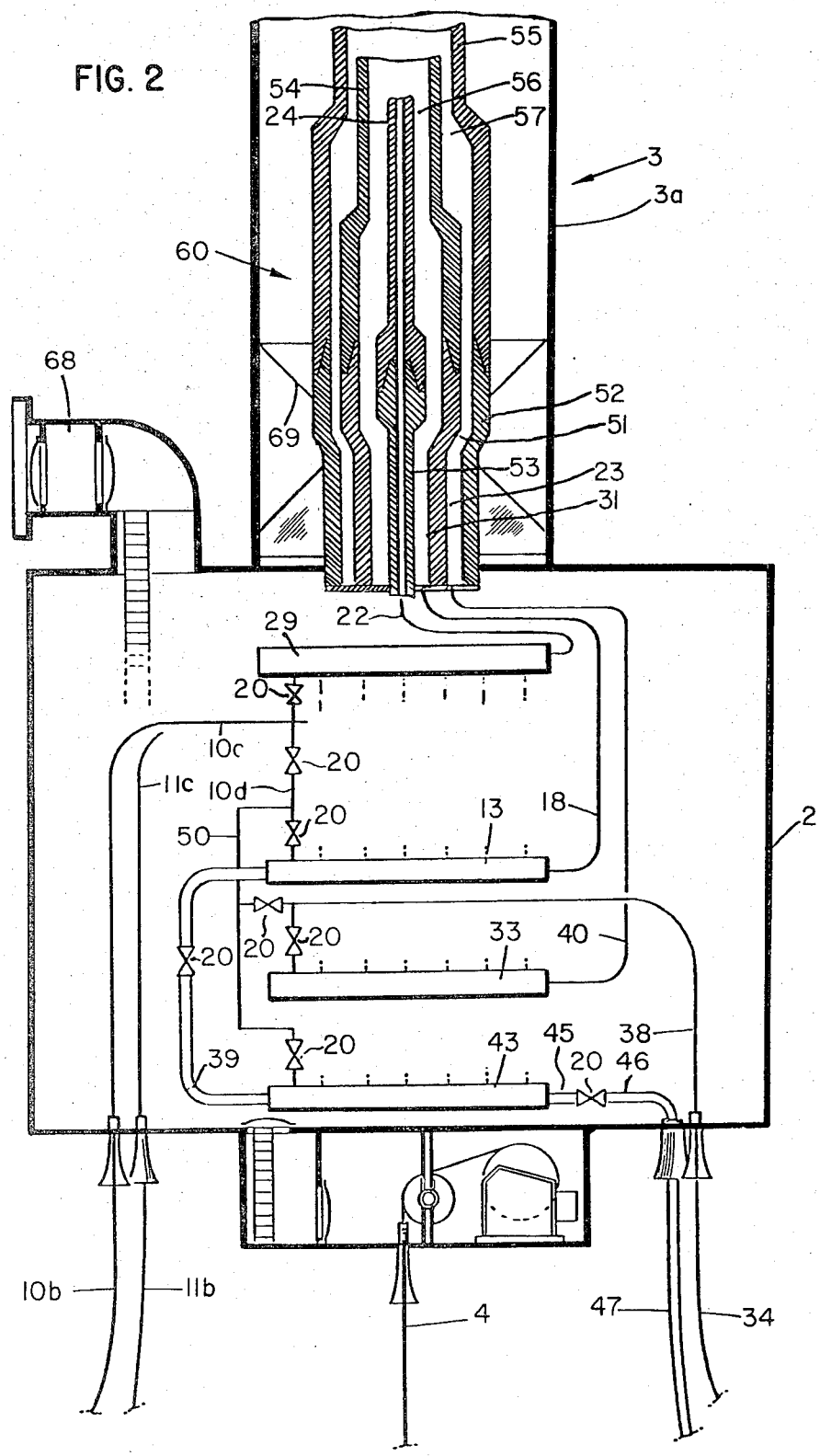
FIG. 2 diagrammatically shows the caisson and the lower part of the telescopic column, in axial section.

Caisson 2 also preferably houses a fourth manifold 43 through which some of the above mentioned conduits can be connected to a flare 44 (FIG. 1), the connection of these conduits to manifold 43 being for example achieved as diagrammatically illustrated in FIG. 2.

Connection of manifold 43 to flare 44 is achieved through conduits 45 and 46 and flexible pipes 47 and 48, the latter being anchored to the heavy mass 49. Production manifold 13 is connected to flare manifold 43 through conduits such as 39. Similarly, each well is separately connected to the flare manifold 43 through a pipe 50.

For safety reasons, two assemblies of conduits and flexible pipes connecting to the flare are preferably used (only one, 45, has been illustrated in the drawings) each of these assemblies being of sufficient diameter to convey by itself, whenever needed, the production of all the wells.

Thus, each of the wells is at the same time separately connected to the production manifold 13, the well annular space safety manifold 33 the return circulation manifold 29 and the flare manifold 43. The interconnecting pipes are provided with manually operated or remotely controlled switch valves 20 such as those diagrammatically shown in FIG. 2 for well 10, the other wells, e.g., 11 and 12, being connected in analogous manner to manifolds 13, 33 and 43.

Access means 68 to the caisson, either direct or through lock, are preferably provided for the personnel in charge of the maintenance of the manifolds and of the associated equipment. Safety venting means will also be provided for the caisson.

In the embodiment illustrated in FIGS. 1 and 2, the manifold 29 communicates through conduit 22 with the inner pipe 24 of the riser 3, the production manifold 13 communicates through conduit 18 with the annular space 56 defined between the inner pipe 24 and the intermediate pipe 54 of the riser 3. The circulation and safety manifold 33 communicates through conduit 40 with the outer coaxial pipe 55. Pipes 54 and 55 define an annular space 57 therebetween through which safety fluid may be supplied to manifold 33, and thence through conduits such as 38 and 34 to individual wells. Coaxial pipes 24, 54 and 55 may be formed from rigid or flexible conduits.

Figure 3:
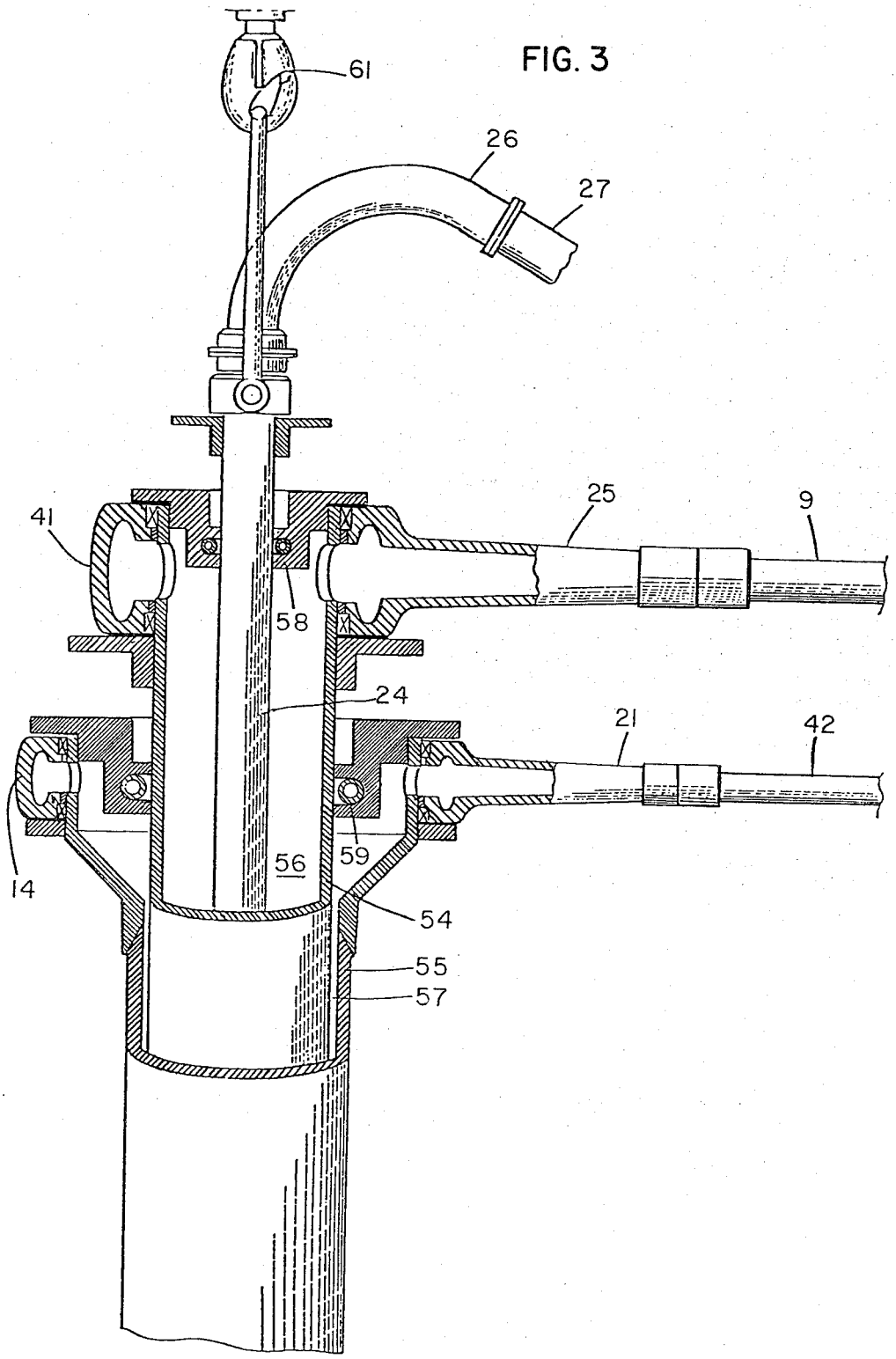
FIGS. 3 and 4 illustrate the step of connecting the telescopic column to the underwater caisson.
Figure 4:
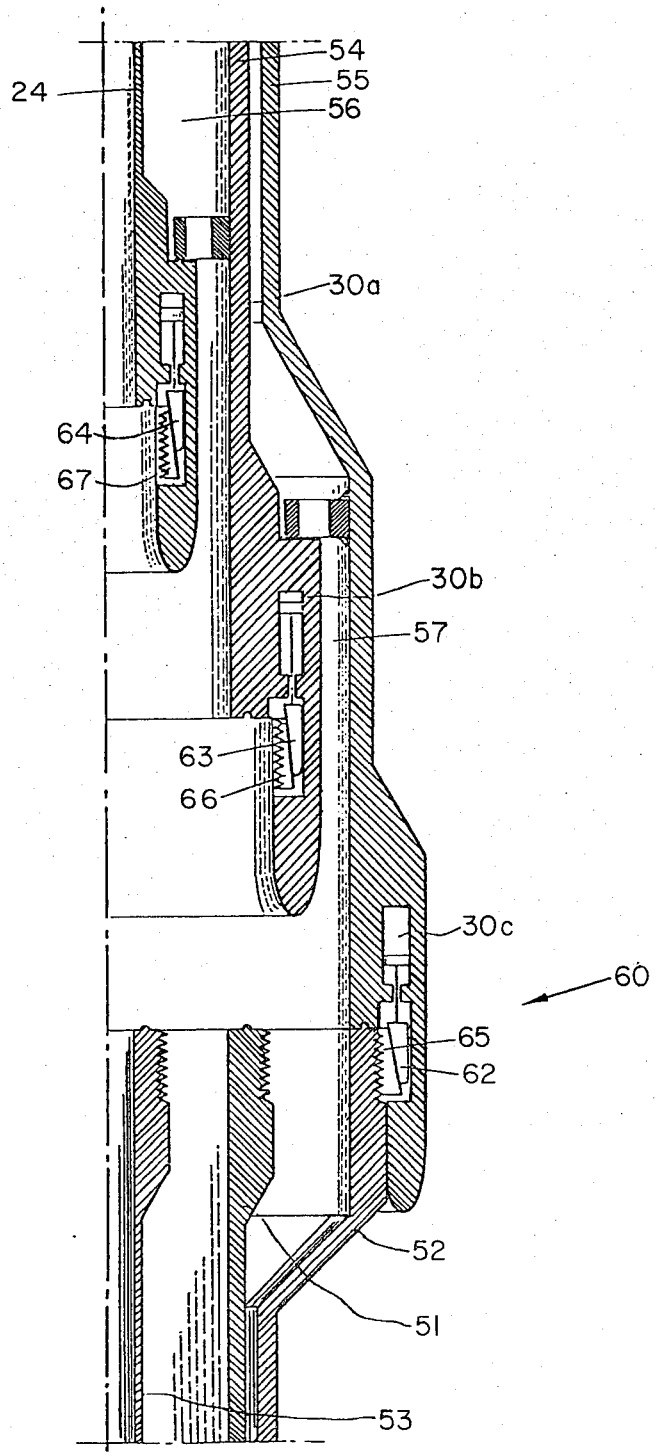

The coaxial pipes of the riser 3 preferably form a telescopic tubular assembly, as shown in FIGS. 2, 3 and 4, to facilitate their rapid and releasable connection by means of a connector 60 located on the caisson 2.

A central conduit 53 communicates with conduit 22 and manifold 29, and connects with central pipe 24. An intermediate conduit 51 forms with the inner pipe an annular space 31 communicating with production conduit 18 and manifold 13, and connects with intermediate pipe 54. Outer coaxial conduit 52 connects with outer pipe 55. The annular space 23 formed by conduits 51 and 52 communicates with circulation and safety conduit 40 and manifold 33.

The annular space 57 is limited at its upper end by the rotary coupling 14 and the cap 59 through which the pipe 54 is sealingly slidable (FIG. 3). Similarly the annular space 56 is limited at its upper end by the rotary coupling 41 and by the cap 58 through which the internal pipe 24 is sealingly slidable.

Rotary coupling 14 leads through pipe 21 to circulation and safety pipe 42 carried by rotatable arm 5. Intermediate pipe 54 communicates with production pipe 9 also carried by the rotatable arm 5, via the rotary coupling 41. The internal pipe 24 is connected through conduit 26 to return circulation pipe 27 carried by rotatable arm 5.

In a mooring station and transfer terminal according to the invention, where the watertight caisson 2 is submerged at a substantial depth, the telescopic riser 3 facilitates connecting and disconnecting operations.

As shown in FIGS. 3 and 4, connection of the three pipes 24, 54 and 55 to caisson 2 is effected successively by means of a lifting hook or travelling block 61 supported from a surface installation, e.g., a ship or platform, through a heave compensator which may be of a known type. Connector 60 is lowered by sliding within tube 3*a*. Its accurate positioning may be achieved through a funnel-shaped guiding device 69 at the lower end of tube 3*a* (FIG. 2).

External pipe 55 is first connected to caisson 2 by coupling to outer connector conduit 52. Pipe 54 and 24 are thereafter successively lowered by hook 61 (FIG. 3) and coupled to intermediate connector conduit 51 and inner connector conduit 53 respectively. Because of the telescopic arrangement of the riser pipes, accurate preliminary orientation of the inner pipe is unnecessary before connecting it to the inner conduit of the connector.

Connector 60 is advantageously provided with remotely controlled hydraulic locking means 62, 63 and 64 and locking wedges 65, 66 and 67 (FIG. 4). Hydraulic pressure in locking circuits 30*a*, 30*b* and 30*c* engage the locking wedges with cooperating teeth in the connector conduits. Quick release of the riser pipes is effected to releasing the pressure in the locking circuits, resulting in rapid retraction of the locking wedges by resilient return means (not shown). Both pipes can then be pulled up at the same time.

In the foregoing illustration, the production manifold 13 communicates with the intermediate annular space 56 of the riser, the circulation and safety manifold 33 communicates with the outer annular space 57, and the return circulation manifold 29 communicates with the central pipe 24. It is understood that different arrangements are also within the scope of the invention.

Additional coaxial pipes may be present in telescopic arrangement and may connect additional subsurface facilities with their surface counterparts through a riser and connector according to the invention, having additional annular spaces defined by the additional pipes.

Figure 5:
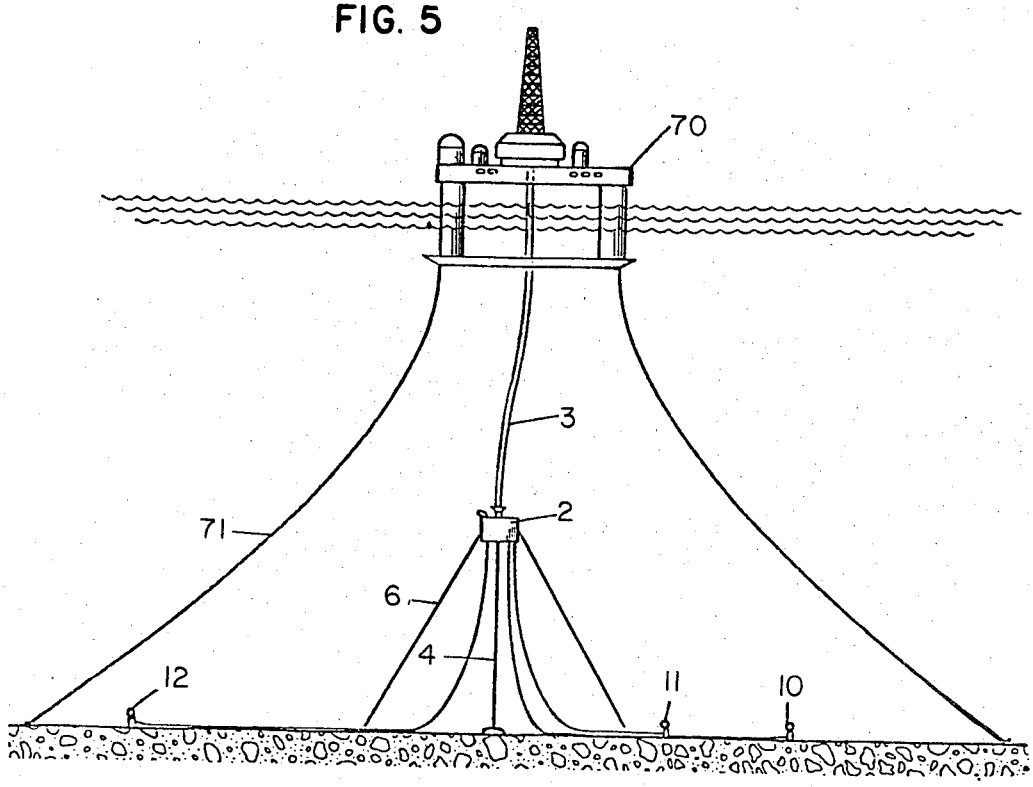
FIGS. 5 and 6 illustrate two other embodiments.
Figure 6:
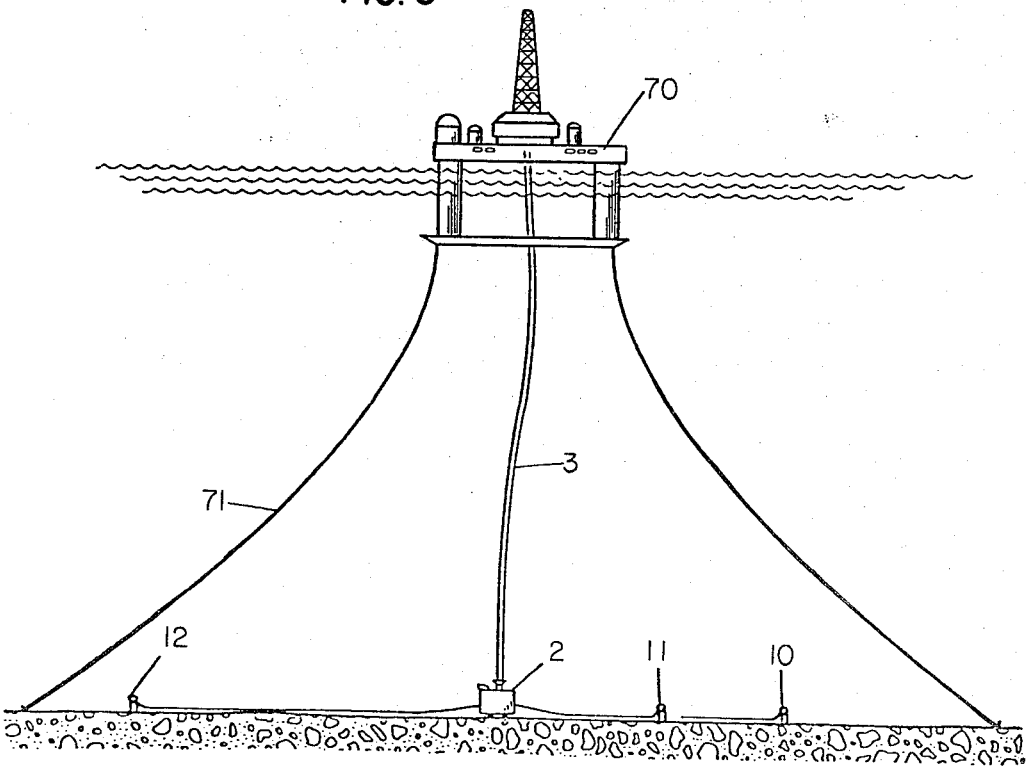

FIGS. 5 and 6 illustrate embodiments of the invention which can be used at great water depths.

In these embodiments, riser 3 is supported at its upper part by a production platform 70 held in position by any suitable means, such as mooring lines 71.

In the embodiment illustrated in FIG. 5, the caisson 2 is also of positive buoyancy and kept submerged as in the embodiment of FIG. 1.

In the embodiment of FIG. 6 this caisson rests on the water bottom. It may optionally be replaced by a simple support structure for manifolds 13, 33 and 43, and for the means connecting these elements in the coaxial conduits of riser 3 and to the flare, if these elements are not to be housed in a watertight container.

In another embodiment, the flexible riser 3 of FIGS. 5 and 6 will be housed in a rigid protecting tube, such as tube 3*a* of FIGS. 1 and 2, this tube being connected to platform 70 by a suitable rigid connecting structure and being releasably connected to caisson 2 at the level of connector 60 of flexible riser 3.

The system can thus be operated with the rigid tube 3*a* disconnected from caisson 2, particularly at shallow depths of the latter, the caisson being then connected to platform 70 only by flexible riser 3. Alternatively the system can be operated with the rigid tube 3*a* connected to caisson 2 especially when this caisson is immersed at a great depth.

In the latter case, when platform 70 is subjected to vertical alternating pounding movements with respect to caisson 2, the flexible riser 3 will not be subjected to excessive stresses, since the pounding movements of platform 70 are then transmitted to the flexible lines such as 71 located at the lower part of the system, through the rigid assembly constituted by the rigid structure connecting the protecting tube 3*a* to platform 70, by the rigid tube 3*a* itself and by the caisson 2 to which this tube is connected.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A mooring station and transfer terminal for offshore hydrocarbon production from a plurality of underwater wells connected to a plurality of production lines, each line communicating with one of said wells, said mooring station and transfer terminal comprising:

at least one underwater production manifold communicating with said production lines;

at least one underwater circulation and safety manifold communicating with said plurality of underwater wells; at least one return circulation manifold communicating with said plurality of underwater wells; a riser comprising at least three coaxial pipes defining at least two annular space therebetween, said coaxial pipes including at least one production pipe communicating at its lower end with said production manifold, at least one circulation and safety pipe communicating at its lower end with said circulation and safety manifold, and at least one return circulation pipe communicating at its lower end with said return circulation manifold; and a surface facility comprising means for receiving the outflow of said at least one production pipe and communicating with the upper end thereof, said surface facility further comprising a source of safety fluid communicating with the upper end of said circulation and safety pipe.

2. A mooring station and transfer terminal according to claim 1, which further comprises an underwater connector comprising at least three coaxial conduits, comprising at least one conduit communicating at its lower end with said production manifold, at least one conduit communicating at its lower end with said circulation and safety manifold; and at least one conduit communicating at its lower end with said return circulation manifold, and wherein the lower end of said riser is adapted to releasably connect with the upper end of said connector, the coaxial pipes of said riser cooperating with corresponding coaxial conduits of said connector.

3. A mooring station and transfer terminal according to claim 1, wherein said riser comprises a telescopic column formed of at least three coaxial pipes, comprising said at least one production pipe, said at least one circulation and safety pipe and said at least return circulation pipe, and wherein each annular space defined by said coaxial pipes is limited at its upper end by sliding sealing means.

4. A mooring station and transfer terminal according to claim 2, wherein said riser comprises coaxial telescopic means for connecting said riser to said underwater connector.

5. A mooring and transfer terminal according to claim 4, which further comprises a submerged watertight caisson within which said at least one production manifold, said at least one circulation and safety manifold and said fluid return manifold are housed, said underwater connector being secured to the upper part of said caisson.

6. A mooring station and transfer terminal according to claim 5, which further comprises a watertight tubular column secured to the top of said caisson within which said connector at the upper part of the caisson is housed.

7. A mooring station and transfer terminal according to claim 5, which further comprises quickly releasable connecting means for connecting said telescopic means to said caisson.

8. A mooring station and transfer terminal according to claim 5, wherein said caisson has a positive buoyancy and does not rest on the water bottom.

9. A mooring station and transfer terminal according to claim 5, comprising access means for maintenance personnel into said caisson.

10. A mooring station and transfer terminal according to claim 1, wherein said riser is flexible and said surface facility is a floating structure.

11. A mooring station and transfer terminal according to claim 10, which further comprises a submerged watertight caisson within which said at least one production manifold, said at least one circulation and safety manifold and said return circulation manifold are housed, and a rigid protecting pipe supported by said floating structure within which said flexible riser is housed, the lower end of said rigid pipe being adapted to be releasably connected to said caisson.

12. A mooring station and transfer terminal according to claim 1, which further comprises a flare manifold communicating with said plurality of production lines, and a flare communicating with said flare manifold.

* * * * *